US010156827B2

(12) United States Patent
Chadani et al.

(10) Patent No.: US 10,156,827 B2
(45) Date of Patent: Dec. 18, 2018

(54) CARTRIDGE AND IMAGE FORMING APPARATUS

(71) Applicant: CANON KABUSHIKI KAISHA, Tokyo (JP)

(72) Inventors: Kazuo Chadani, Suntou-gun (JP); Tetsuya Numata, Suntou-gun (JP); Takuya Kawakami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/496,342

(22) Filed: Apr. 25, 2017

(65) Prior Publication Data

US 2017/0315504 A1 Nov. 2, 2017

(30) Foreign Application Priority Data

Apr. 28, 2016 (JP) ..... 2016-091441

(51) Int. Cl.
*G03G 21/18* (2006.01)

(52) U.S. Cl.
CPC ..... *G03G 21/1814* (2013.01); *G03G 21/1864* (2013.01); *G03G 21/185* (2013.01); *G03G 2221/1654* (2013.01)

(58) Field of Classification Search
CPC ..... G03G 21/1647; G03G 21/1842; G03G 21/1814; G03G 21/1821
See application file for complete search history.

(56) References Cited

U.S. PATENT DOCUMENTS

2005/0220481 A1* 10/2005 Yamaguchi ..... G03G 21/185 399/111
2007/0160388 A1* 7/2007 Yoshimura ..... G03G 21/1825 399/111
2009/0290904 A1 11/2009 Kawai
2009/0297214 A1 12/2009 Chadani
2014/0376953 A1* 12/2014 Kakuta ..... G03G 21/0029 399/102

FOREIGN PATENT DOCUMENTS

EP 1596258 A2 11/2005
JP 2009282352 A 12/2009

* cited by examiner

*Primary Examiner* — Walter L Lindsay, Jr.
*Assistant Examiner* — Jessica L Eley
(74) *Attorney, Agent, or Firm* — Canon U.S.A, Inc. IP Division

(57) ABSTRACT

A cartridge including a photosensitive drum, a cleaning unit that supports the photosensitive drum, a process member that acts on the photosensitive drum, the cartridge being detachable from a main body of the image forming apparatus in a rotational axial direction of the photosensitive drum. The cartridge further including a first position determination position determining a downstream position with respect to the main body in a mounting direction of the photosensitive drum, and a second position determination portion that determines an upstream position with respect to the main body in the mounting direction. Furthermore, in a cross section orthogonal to the mounting direction, a distance from an axis of rotation of the photosensitive drum to the second position determination portion in a predetermined direction is larger than a distance from the axis of rotation to the first position determination portion in the predetermined direction.

9 Claims, 10 Drawing Sheets

CARTRIDGE AND IMAGE FORMING APPARATUS

BACKGROUND OF THE INVENTION

Field of the Invention

The present disclosure relates to a process cartridge and an image forming apparatus employing the same. Note that a process cartridge is a member in which an electrophotographic photoconductor and a process member that acts on the electrophotographic photoconductor are formed into a cartridge in an integrated manner, and is a member that is detachably mounted on a main body of an electrophotographic image forming apparatus. For example, the above process cartridge includes a process cartridge in which an electrophotographic photoconductor, and at least one of a developing member, a charging member, and a cleaning member that serve as a process member is integrated into a cartridge.

Furthermore, an electrophotographic image forming apparatus is an apparatus that forms an image on a recording medium using an electrophotographic image forming system. Examples of the electrophotographic image forming apparatus include, for example, an electrophotographic copying machine, an electrophotographic printer (LED printer, laser printer, and the like), a facsimile machine, and a word processor.

Description of the Related Art

In an electrophotographic image forming apparatus (hereinafter, referred to as an image forming apparatus), typically, a drum-type electrophotographic photoconductor (hereinafter, referred to as a photosensitive drum) serving as an image bearing member is uniformly charged. An electrostatic latent image (an electrostatic image) is formed on the photosensitive drum by selectively exposing the charged photosensitive drum. Subsequently, the electrostatic latent image formed on the photosensitive drum is developed as a toner image with toner serving as the developer. Subsequently, the toner image formed on the photosensitive drum is transferred onto a recording material such as a recording sheet or a plastic sheet and, further, heat and pressure is applied to the toner image transferred on the recording material to fix the toner image on the recording material and to perform image recording.

Typically, such an image forming apparatus needs to have toner supplied thereto and maintenance needs to be performed on the various process members thereof. A process cartridge (hereinafter, referred to as a cartridge) that is detachable from a main body of the image forming apparatus is in practical use in which, in order to facilitate supply of toner and maintenance, a photosensitive drum, a charging member, a developing member, a cleaning member, and the like are collectively formed into a cartridge.

The process cartridge system allows the user to perform maintenance on the device; accordingly, operability is improved significantly such that an image forming apparatus with excellent usability can be provided. Accordingly, the process cartridge system is widely used in image forming apparatuses.

As described above, the cartridge is detached from and attached to the image forming apparatus by the user; accordingly, a configuration is in need that enables the cartridge to be easily replaced without damaging the cartridge during attachment and detachment of the cartridge.

Japanese Patent Laid-Open No. 2009-282352 proposes a configuration in which the position of the cartridge with respect to the image forming apparatus is set by moving the components inside the image forming apparatus after the cartridge has been mounted in the image forming apparatus.

However, in a configuration in which the components are disposed inside the image forming apparatus and positioning is performed by moving the cartridge, disadvantageously, the number of parts increases increasing the cost accordingly and, furthermore, the configuration becomes complex, assembly becomes complicated, and the image forming apparatus becomes large in size.

Accordingly, the present disclosure provides a cartridge and an image forming apparatus that support the cartridge with a simple configuration, decrease the manufacturing cost, enable assembly to be easily performed, and reduce the size of the body of the image forming apparatus.

SUMMARY OF THE INVENTION

A cartridge according to the present disclosure includes a photosensitive drum, a cleaning unit that rotatably supports the photosensitive drum, at least one process member that acts on the photosensitive drum in which the cartridge is detachable with respect to an image forming apparatus in a rotational axial direction of the photosensitive drum, the rotational axial direction being a mounting direction of the cartridge. The cartridge further includes a first position determination portion provided on a downstream side of the photosensitive drum in the mounting direction to determine a downstream side position of the photosensitive drum with respect to the main body of the apparatus in the mounting direction, and a second position determination portion provided on an upstream side of the photosensitive drum in the mounting direction to determine an upstream side position of the photosensitive drum with respect to the main body of the apparatus in the mounting direction. In the cartridge, in a cross section orthogonal to the mounting direction, a distance from an axis of rotation of the photosensitive drum to the second position determination portion in a predetermined direction is larger than a distance from the axis of rotation of the photosensitive drum to the first position determination portion in the predetermined direction.

Furthermore, an image forming apparatus according to the present disclosure includes a cartridge including a photosensitive drum, a cleaning unit that rotatably supports the photosensitive drum, and at least one process member that acts on the photosensitive drum, a first side plate, and a second side plate, in which the cartridge is detachable in a rotational axial direction of the photosensitive drum. The cartridge includes a first position determination portion provided downstream in a mounting direction of the cartridge, and a second position determination portion provided upstream in the mounting direction. The first side plate is disposed downstream in the mounting direction and includes a first regulating portion that supports the first position determination portion. The second side plate is disposed upstream in the mounting direction and includes a second regulating portion that supports the second position determination portion. In a cross section orthogonal to the mounting direction, a distance from an axis of rotation of the photosensitive drum to the second position determination portion in a predetermined direction is larger than a distance from the axis of rotation of the photosensitive drum to the first position determination portion in the predetermined direction.

Further features of the present invention will become apparent from the following description of exemplary embodiments with reference to the attached drawings.

DESCRIPTION OF THE EMBODIMENTS

First Exemplary Embodiment

A mode according to a first exemplary embodiment of the present disclosure will be described in detail with reference to the drawings. Note that in the following description, a longitudinal direction is a rotational axial direction of a photosensitive drum. Furthermore, in the longitudinal direction, a side in which the photosensitive drum receives driving force from a main body of an image forming apparatus is referred to as a drive side, and a side opposite to the drive side is referred to as a non-drive side.

Figure 2:
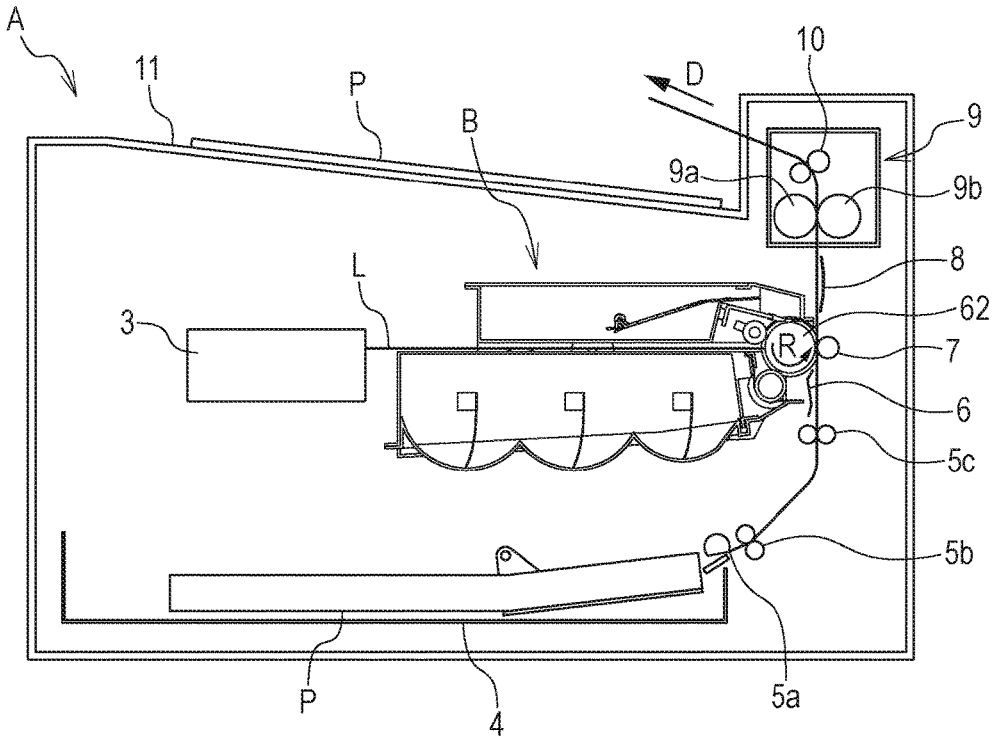
FIG. 2 is a cross-sectional view of the image forming apparatus according to the first exemplary embodiment.
Figure 3:
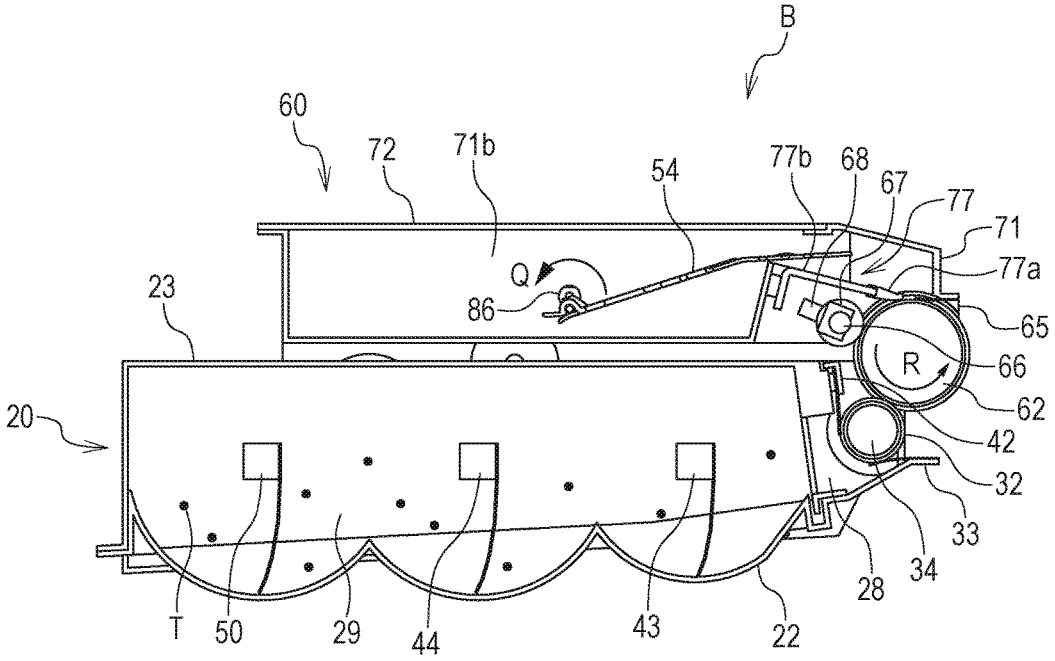
FIG. 3 is a cross-sectional view of the cartridge according to the first exemplary embodiment.

Referring to FIGS. 2 and 3, an overall configuration and an image forming process will be described. FIG. 2 is a cross-sectional view of the main body A of the image forming apparatus and a cartridge B. FIG. 3 is a cross-sectional view of the cartridge B. Note that the main body A of the image forming apparatus is the image forming apparatus in which the cartridge B is not included.

Overall Configuration of Image Forming Apparatus

The image forming apparatus illustrated in FIG. 2 is a laser beam printer employing an electrophotographic technology in which the cartridge B is detachable from the main body A of the apparatus. In a case in which the cartridge B is mounted in the main body A of the apparatus, an exposure device 3 (a laser scanner unit) is disposed so as to oppose a photosensitive drum 62. Furthermore, a sheet tray 4 that contains recording mediums (hereinafter, referred to as sheet materials P) that are subject to formation of image is disposed below the cartridge B.

Furthermore, a pickup roller 5*a*, a pair of feed rollers 5*b*, a pair of conveyance rollers 5*c*, a transfer guide 6, a transfer roller 7, a conveyance guide 8, a fixing device 9, a pair of discharging rollers 10, a discharge tray 11, and other members are sequentially disposed along a conveying path of the sheet material P in the main body A of the apparatus. Note that the fixing device 9 includes a heat roller 9*a* and a pressure roller 9*b*.

Image Forming Process

An outline of the image forming process will be described next. Based on a print start signal, the photosensitive drum 62 is rotationally driven at a predetermined circumferential velocity (processing speed) in an arrow R direction. As illustrated in FIG. 3, a charging roller 66 serving as a charging member to which a bias voltage is applied comes in contact with an outer peripheral surface of the photosensitive drum 62, and charges the outer peripheral surface of the photosensitive drum 62 in a uniform manner.

The device 3 outputs a laser beam L according to image information. The laser beam L passes through a developer container 23 and a cleaning frame 71 of the cartridge B and scans and exposes the outer peripheral surface of the photosensitive drum 62. With the above, an electrostatic latent image according to the image information is formed on the outer peripheral surface of the photosensitive drum 62.

Meanwhile in a developing unit 20 serving as a developing device, toner T inside a toner chamber 29 is stirred and conveyed by rotation of a first conveying member 43, a second conveying member 44, and a third conveying member 50, and is sent out to a toner supply chamber 28. The toner T is carried on a surface of a development roller 32 serving as a developing member with magnetic force of a magnet roller 34 (a stationary magnet). The toner T that is carried on the surface of the development roller 32 is triboelectrically charged with a development blade 42 while the layer thickness of the toner T on a peripheral surface of the development roller 32 is restricted. Subsequently, the electrostatic latent image on the photosensitive drum 62 is turned into a visible image, that is, a toner image, with the layer of toner formed on the development roller 32.

Furthermore, as illustrated in FIG. 2, synchronizing with the output timing of the laser beam L, the sheet material P contained in the lower portion of the main body A of the apparatus is fed from the sheet tray 4 with the pickup roller 5*a*, the pair of feed rollers 5*b*, and the pair of conveyance rollers 5*c*. Subsequently, the sheet material P passing through the transfer guide 6 is fed to a transfer position between the photosensitive drum 62 and the transfer roller 7. The toner image is sequentially transferred to the sheet materials P from the photosensitive drum 62 at the above transfer position.

The sheet material P to which the toner image has been transferred is separated from the photosensitive drum 62 and is conveyed along the conveyance guide 8 to the fixing device 9. Subsequently, the sheet material P passes through a nip portion between the heat roller 9*a* and the pressure roller 9*b* included in the fixing device 9. A compressing and heat fixing process is performed on the sheet material P at the nip portion and the toner image is fixed to the sheet material P. The sheet material P that has undergone the fixing process of the toner image is conveyed to the pair of discharging rollers 10 and is discharged on a discharge tray 11.

Meanwhile, as illustrated in FIG. 3, the residual toner on the outer peripheral surface of the photosensitive drum 62 that has performed transferring is removed by a cleaning member 77 serving as a cleaning device and the photosensitive drum 62 is used once more in the image forming process. The toner that has been removed from the photosensitive drum 62 is stored in a waste toner chamber 71*b* of a cleaning unit 60. Note that in the above, the charging roller 66, the development roller 32, and the cleaning member 77 are the process members that act on the photosensitive drum 62.

Overall Configuration of Cartridge

Figure 6:
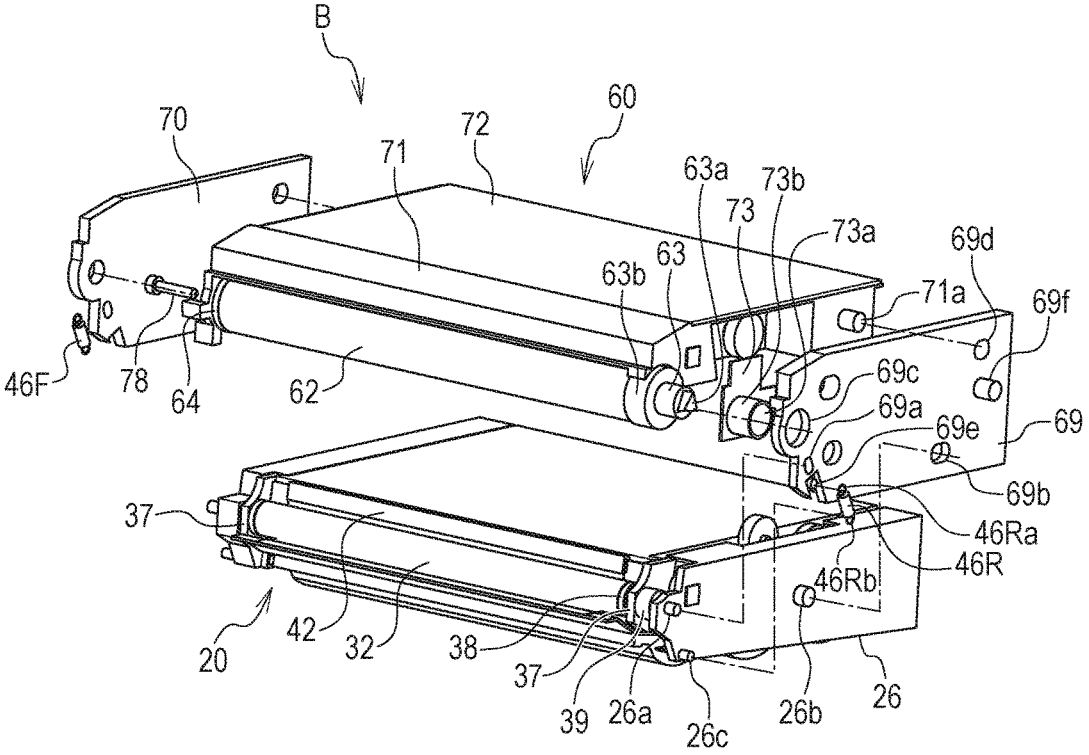
FIG. 6 is a perspective view for describing a configuration of the cartridge according to the first exemplary embodiment.
Figure 7:
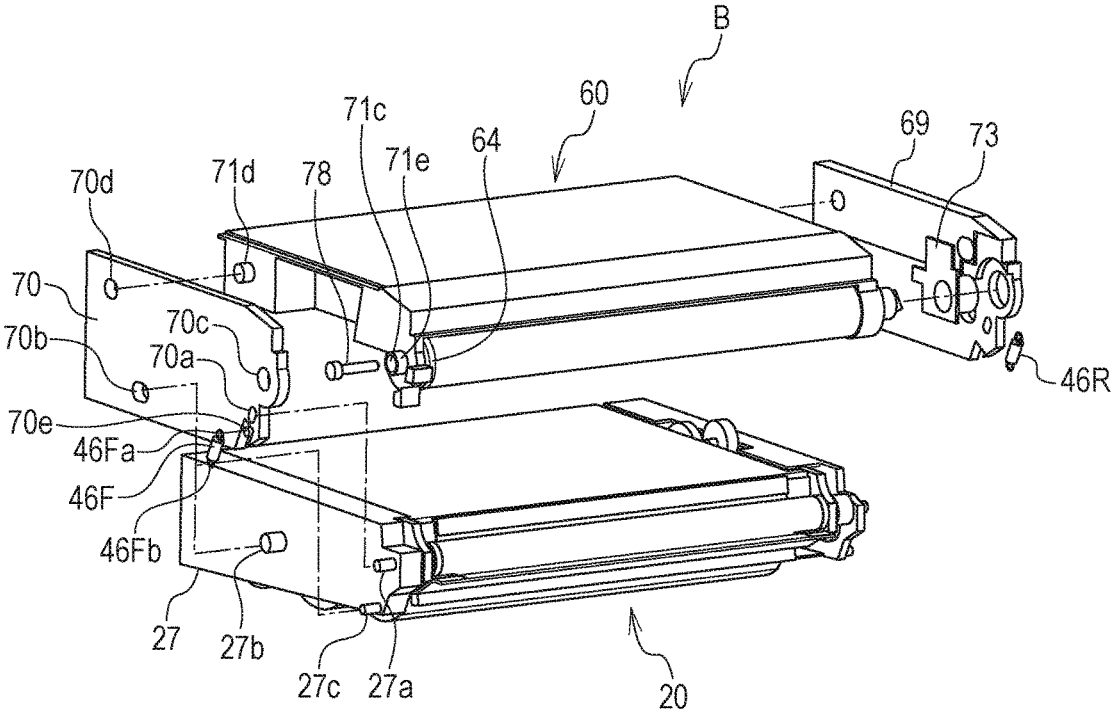
FIG. 7 is a perspective view for describing the configuration of the cartridge according to the first exemplary embodiment.

The overall configuration of the cartridge B will be described with reference to FIGS. 3, 6, and 7. FIG. 3 is a cross-sectional view of the cartridge B, and FIGS. 6 and 7 are perspective views for describing the configuration of the cartridge B. Note that in the present exemplary embodiment, screws fastening the components are omitted from the description.

Referring to FIG. 3, the cartridge B according to the present exemplary embodiment will be described in further detail. The cartridge B includes the cleaning unit 60 and the developing unit 20. The cleaning unit 60 and the developing unit 20 are integrated in a pivotal manner such that the development roller 32 of the cleaning unit 60 and the photosensitive drum 62 of the developing unit 20 can be abutted and separated from each other. Note that a process cartridge (a cartridge) is typically a member in which a photosensitive drum and at least one of a charging member, a developing member, and a cleaning member that serve as process members are formed into a cartridge in an integrated manner so as to be detachable from a body of an image forming apparatus. In the present disclosure, the cartridge at least includes the cleaning unit according to the present disclosure.

The cleaning unit 60 includes the photosensitive drum 62, the charging roller 66, the cleaning member 77, the cleaning frame 71 that supports the above members, and a lid member 72 that is fixed to the cleaning frame 71 by welding or the like. In the cleaning unit 60, the charging roller 66 and the cleaning member 77 are disposed so as to be in contact with the outer peripheral surface of the photosensitive drum 62.

The cleaning member 77 includes a blade-shaped rubber blade member 77*a* formed of rubber (an elastic member), and a supporting member 77*b* that supports the rubber blade. The rubber blade member 77*a* is abutted against the photosensitive drum 62 in a direction that counters a rotational direction of the photosensitive drum 62. In other words, the rubber blade member 77*a* is abutted against the photosensitive drum 62 such that a tip of the rubber blade member 77*a* is oriented towards the upstream side in the rotational direction of the photosensitive drum 62. The waste toner that has been removed from the surface of the photosensitive drum 62 with the cleaning member 77 is conveyed to the waste toner chamber 71*b*, which is formed by the cleaning frame 71 and the lid member 72, with a waste toner conveying member 54. The waste toner conveying member 54 engages with a crank member 86, rotates in an arrow Q direction in the drawing by having drive transmitted from the crank member 86, such that the waste toner is conveyed. Furthermore, in order to prevent the waste toner from leaking from the waste toner chamber 71*b*, a scooping sheet 65 is provided so as to abut against the photosensitive drum 62 at an edge portion of the cleaning frame 71 opposing the photosensitive drum 62.

By transmitting driving force of a body drive motor (not shown) serving as a drive source to the cleaning unit 60, the photosensitive drum 62 is rotationally driven in the arrow R direction in the drawing in accordance with the image forming operation. The charging roller 66 is, at the two ends of the cleaning frame 71 in the longitudinal direction (substantially parallel to a rotational axial direction of the photosensitive drum 62), rotationally attached to the cleaning unit 60 through the charging roller bearings 67. The charging roller 66 is configured so as to be in pressure contact with the photosensitive drum 62 by having the charging roller bearings 67 be pressed towards the photosensitive drum 62 with an urging member 68, and to rotate so as to be driven by the rotation of the photosensitive drum 62.

Meanwhile, the developing unit 20 includes the development roller 32, the developer container 23 that supports the development roller 32, and the development blade 42. The magnet roller 34 is provided inside the development roller 32. The first conveying member 43, the second conveying member 44, and the third conveying member 50 are provided in the toner chamber 29 formed by the developer container 23 and the bottom member 22. The first conveying member 43, the second conveying member 44, and the third conveying member 50 not only stir the toner accommodated inside the toner chamber 29 but also convey the toner to the toner supply chamber 28. Furthermore, the development blade 42, which restricts the toner layer on the development roller 32 disposed in the opening portion of the toner supply chamber 28, is disposed in the developing unit 20. Spacing members 38 are attached to the development roller 32 at the two end portions of the development roller 32. Upon abutment of the spacing members 38 and the photosensitive drum 62 against each other, the development roller 32 and the photosensitive drum 62 are held with a slight gap in between (FIG. 6). Furthermore, in order to prevent the toner from leaking from the developing unit 20, a bleeding out prevention sheet 33 is provided so as to abut against the development roller 32 at an edge portion of the bottom member 22 that opposes the development roller 32.

As illustrated in FIGS. 6 and 7, the cartridge B described above is configured by integrating the cleaning unit 60 and the developing unit 20 that have been formed.

In the cleaning unit 60, the photosensitive drum 62 to which a drive side drum flange 63 and a non-drive side drum flange 64 is attached is made rotatable with respect to the cleaning frame 71 and the lid member 72 with a drum shaft 78 and a drum bearing 73 serving as a first support. More specifically, the drive side is rotatably supported by inserting the drum flange 63 into a hole portion 73*a* of the drum bearing 73. On the other hand, the non-drive side is rotatably supported by having the drum shaft 78 press fitted into a hole portion 71*c* provided in the cleaning frame 71 and engaged with a hole portion (not shown) of the non-drive side drum flange 64. Note that the drive side drum flange 63 includes a driving force receiving portion 63*a* that receives drive from the main body A of the apparatus, and a flange gear portion 63*b* that transmits the drive to the development roller gear 39 provided on the drive side of the development roller 32.

A drive-side hold member 69 and a non-drive-side hold member 70 that support the developing unit 20 are attached to the two ends of the cleaning frame 71. The drive-side hold member 69 includes a long hole portion 69*d* and a position fixing hole 69*c*. The cleaning unit 60 is fixed to the cleaning frame 71 by inserting a drive side boss 71*a* of the cleaning frame 71 into the long hole portion 69*d*, and by inserting a support 73*b* of the drum bearing 73 attached to the cleaning frame 71 into the position fixing hole 69*c*. On the other hand, the non-drive-side hold member 70 includes a long hole portion 70*d* and a position fixing hole 70*c*. The cleaning unit 60 is fixed to the cleaning frame 71 by inserting a non-drive side boss 71*d* of the cleaning frame 71 into the hole portion 70*d* and inserting an outer diameter portion 71*e* of a cylindrical boss into which the drum shaft 78 is inserted into a position fixing hole 70*c*.

Furthermore, the developing unit 20 is formed by rotatably attaching the development roller 32 to the developer container 23 with bearing members 37 provided at the two ends of the development roller 32. The cartridge B is formed by fitting the drive-side hold member 69 and the non-drive-side hold member 70 to both sides of the developing unit 20 in a movable manner. Specifically, the developing unit 20 includes, on the drive side, a first development support portion 26*a* and a second development support portion 26*b* in a drive-side development-side member 26, and a first long hole 69*a* and a second long hole 69*b* in the drive-side hold member 69. The developing unit 20 is formed such that the first development support portion 26*a* of the drive-side development-side member 26 engages with the first long hole 69*a* of the drive-side hold member 69, and such that the second development support portion 26*b* of the drive-side development-side member 26 engages with the second long hole 69*b* of the drive-side hold member 69. In a similar manner, the developing unit 20 includes, on the non-drive side, a third development support portion 27*a* and a fourth development support portion 27*b* in a non-drive-side development-side member 27, and a third long hole 70*a* and a fourth long hole 70*b* in the non-drive-side hold member 70. The developing unit 20 is formed such that the third development support portion 27*a* of the non-drive-side development-side member 27 engages with the third long hole 70*a* of the non-drive-side hold member 70, and such that the fourth development support portion 27*b* of the non-drive-side development-side member 27 engages with the fourth long hole 70*b* of the non-drive-side hold member 70. The developing unit 20 is supported by the cleaning unit 60 in the above manner through the drive-side hold member 69 and the non-drive-side hold member 70, such that the cleaning unit 60 and the developing unit 20 are integrated.

The second long hole 69*b* is formed larger than the second development support portion 26*b*, and the fourth long hole 70*b* is formed larger than the fourth development support portion 27*b*. Accordingly, the developing unit 20 is formed so as to be pivotal about the first development support portion 26*a* engaged with the first long hole 69*a* and about the third development support portion 27*a* engaged with the third long hole 70*a*. Furthermore, on the drive side, a first hole portion 46Ra of a drive side urging member 46R is hooked to a boss 69*e* of the drive-side hold member 69, and a second hole portion 46Rb of a drive side urging member 46R is hooked to a boss 26*c* of the drive-side development-side member 26. In a similar manner, a first hole portion 46Fa of a non-drive side urging member 46F is hooked to a boss 70*e* of the non-drive-side hold member 70, and a second hole portion 46Fb of a non-drive side urging member 46F is hooked to a boss 27*c* of the non-drive-side development-side member 27. The present exemplary embodiment is configured such that a tension spring is used for each of the drive side urging member 46R and the non-drive side urging member 46F to bias the developing unit 20 towards the cleaning unit 60 with the urging force of the spring so that the development roller 32 is reliably pushed towards the photosensitive drum 62. As described above, the development roller 32 is formed so as to maintain a predetermined space with the photosensitive drum 62 by the spacing members 38 attached to the two end portions of the development roller 32.

Attachment and Detachment of Cartridge

Figure 4:
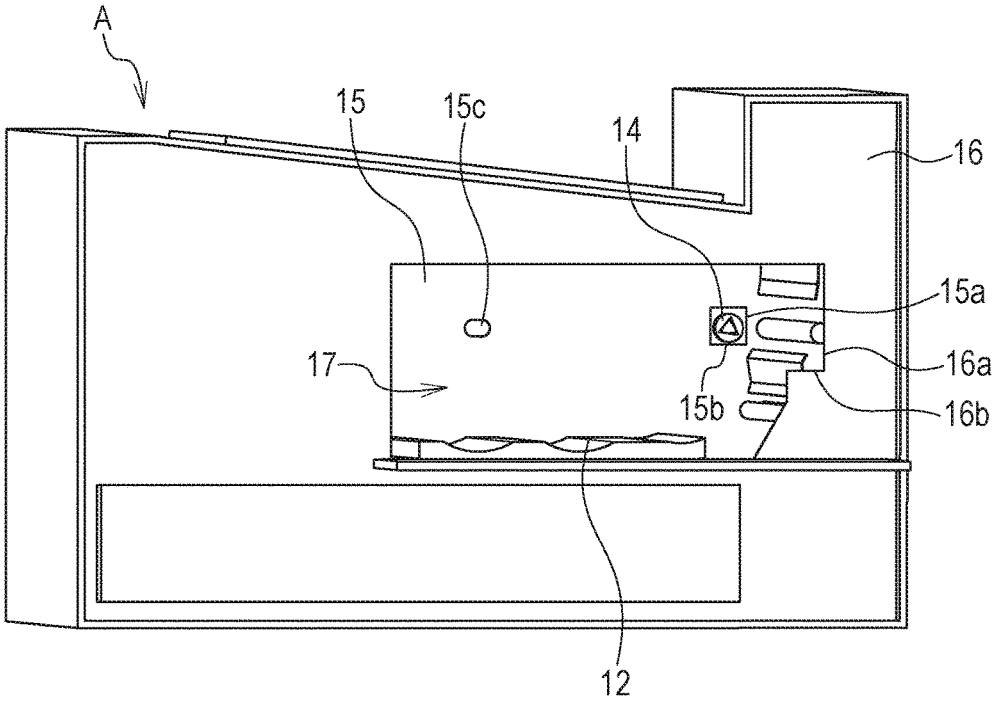
FIG. 4 is a side view of the image forming apparatus according to the first exemplary embodiment.
Figure 5:
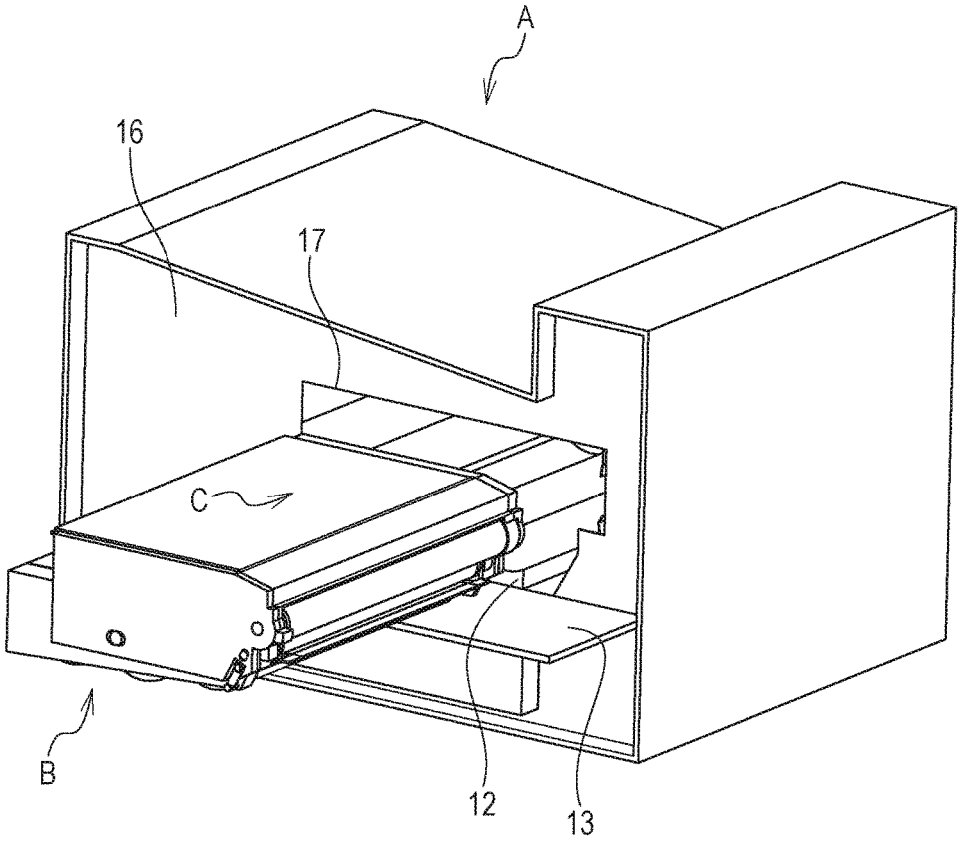
FIG. 5 is a perspective view of a main body of the image forming apparatus and the cartridge according to the first exemplary embodiment in which an opening has been opened.

Referring next to FIGS. 4 and 5, attachment and detachment of the cartridge B with respect to the main body A of the apparatus will be described. FIG. 4 is a perspective view of the main body A of the apparatus in which an opening 13 is open for attaching and detaching the cartridge B. FIG. 5 is a perspective view of the cartridge B and the main body A of the apparatus in which the opening 13 is open for attaching and detaching the cartridge B.

The opening 13 is attached to the main body A of the apparatus in a pivotal manner. When the opening 13 is opened, a cartridge mount hole 17 in a non-drive side plate 16 provided on the non-drive side of the main body A of the apparatus becomes exposed. Furthermore, a cartridge guide 12 for mounting the cartridge B in the main body A of the apparatus is provided in the cartridge mount hole 17, and the cartridge B is mounted inside the main body A of the apparatus along the cartridge guide 12 in an arrow C direction in the drawing.

Note that the arrow C direction is a direction in which the cartridge B is mounted in the main body A of the apparatus from the non-drive side to the drive side and is a direction extending in the axial direction of the photosensitive drum 62. In other words, the non-drive side is the upstream side in the mounting direction of the cartridge B and the drive side is the downstream side in the mounting direction of the cartridge B.

A drive shaft 14 that transmits drive to the driving force receiving portion 63*a* (FIG. 6) of the cartridge B is provided in the main body A of the apparatus. The drive shaft 14 is driven by a motor (not shown) of the main body A of the apparatus, accordingly, the photosensitive drum 62 joined to the driving force receiving portion 63*a* is rotated by receiving the driving force from the main body A of the apparatus. Moreover, power is supplied to the charging roller 66 and the development roller 32 from a power supply unit (not shown) of the main body A of the apparatus.

Cartridge Supporting Configuration

Figure 1:
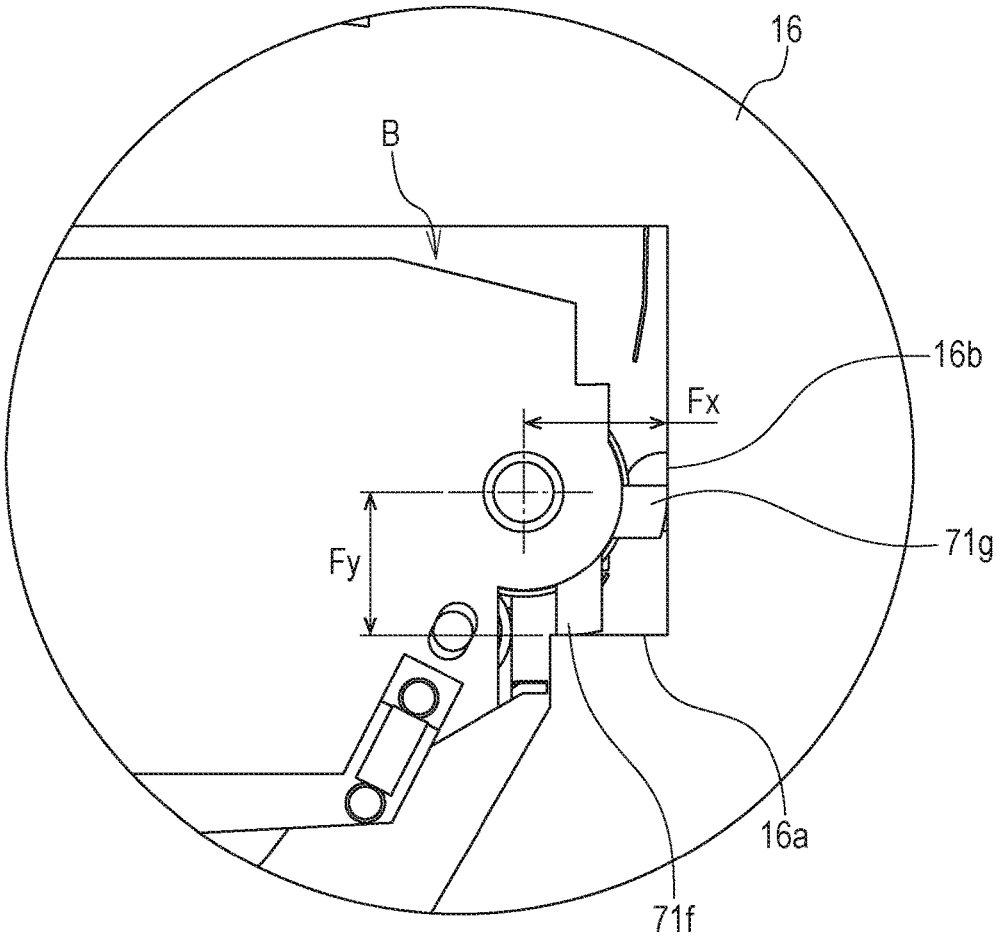
FIG. 1 is a side view of a cartridge and an image forming apparatus according to a first exemplary embodiment.
Figure 8:
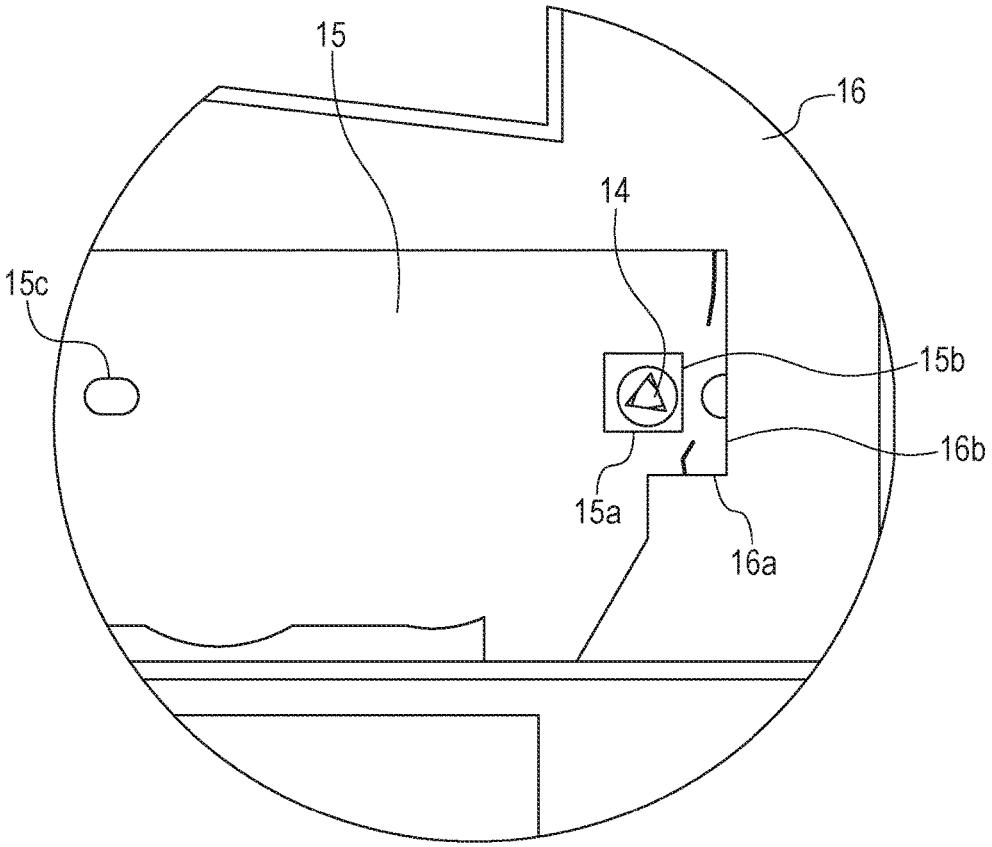
FIG. 8 is a side view of the image forming apparatus according to the first exemplary embodiment.
Figure 9:
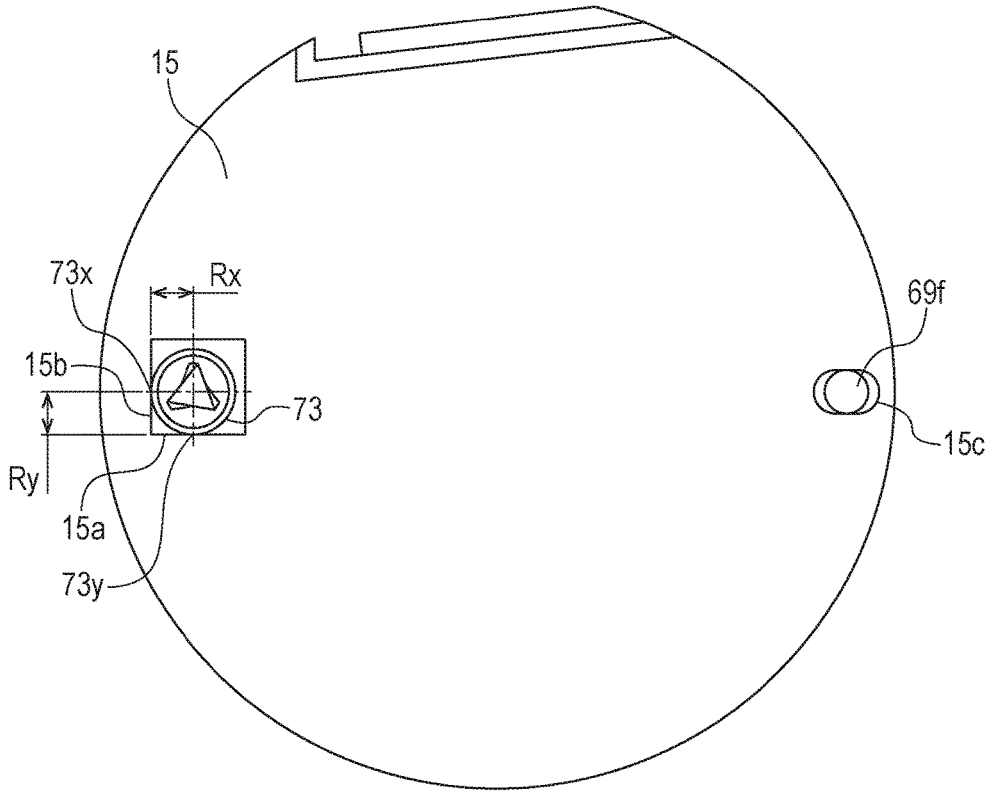
FIG. 9 is a side view of the cartridge and the image forming apparatus according to the first exemplary embodiment.

Referring to FIGS. 1, 8, and 9, a configuration supporting the cartridge B with respect to the main body A of the apparatus will be described. FIG. 1 is a side view viewing the drive side of the main body A of the apparatus and the cartridge B from the non-drive side. FIG. 8 is a side view viewing the drive side of the main body A of the apparatus from the non-drive side. FIG. 9 is a side view viewing the non-drive side of the main body A of the apparatus and the cartridge B from the drive side.

As illustrated in FIG. 8, a drive-side plate 15 and the non-drive side plate 16 that serve as supports that support the cartridge B are provided in the main body A of the apparatus. A first support 15*a* and a second support 15*b* serving as a first regulating portion, and a long hole 15*c* serving as a rotation support of the cartridge B are provided in the drive-side plate 15. Furthermore, a third support 16*a* and a fourth support 16*b* serving as a second regulating portion are provided in the non-drive side plate 16.

Specifically, as illustrated in FIG. 9, on the drive side, a first abutment portion 73*y* that protrudes vertically downwards is provided in the drum bearing 73 in order to support the load of the cartridge B. The first abutment portion 73*y* abuts against the first support 15*a*. Furthermore, a second abutment portion 73*x* that protrudes in a parallel direction with the first support and that determines the position in a direction (a horizontal direction) orthogonal to the first support is provided in the drum bearing 73. The second abutment portion 73*x* abuts against the second support 15*b* of the drive-side plate 15. In other words, the drum bearing 73 (a first position determination portion) is configured such that the first abutment portion 73*y* that protrudes in a predetermined direction is supported by the first support 15*a*, and the position of the second abutment portion 73*x* protruding in a parallel direction with the first abutment portion 73*y* is restricted by the second support 15*b*. Furthermore, on the drive side, a boss 69*f* (FIG. 6) provided in the drive-side hold member 69 enters the long hole 15*c* provided in the drive-side plate 15 such that the cartridge B is supported by the drive-side plate 15.

Meanwhile, on the non-drive side, as illustrated in FIG. 1, a third abutment portion 71*f* that protrudes vertically downwards and that supports the load of the cartridge B is provided in the cleaning frame 71 serving as a second position determination portion that abuts against the third support 16*a*. Furthermore, a fourth abutment portion 71*g* that protrudes in a parallel direction with the third support and that determines the position in a direction orthogonal to the third support (in the horizontal direction) is provided in the cleaning frame 71. The cleaning frame 71 abuts against the fourth support 16*b* of the non-drive-side plate 16. In other words, the cleaning frame 71 (the second position determination portion) is configured such that the load of the cartridge B is supported by the third support 16*a*, and the position is restricted by the fourth support 16*b*.

Note that it is defined that Rx is a distance from a center (an axis of rotation) of the photosensitive drum 62 to the first support 15*a* and Ry is a distance from the center to the second support 15*b*, on the drive side in a state in which the cartridge B is mounted in the main body A of the apparatus. Furthermore, it is defined that Fx is a distance from the center (the axis of rotation) of the photosensitive drum 62 to the third support 16*a* and Fy is a distance from the center to the fourth support 16*b*, on the non-drive side in a state in which the cartridge B is mounted in the main body A of the apparatus.

In the above case, relationships Fx>Rx and Fy>Ry hold true in the present exemplary embodiment. In other words, in a state in which the cartridge B is mounted in the main body A of the apparatus, the distance from the center (the axis of rotation) of the photosensitive drum 62 to the third abutment portion 71*f* is larger than the distance from the center to the first abutment portion 73*y* and, furthermore, compared with the size of the second abutment portion 73*x*, the size of the fourth abutment portion 71*g* is large. In other words, in a cross section orthogonal to a mounting and detaching direction of the cartridge (the axial direction of the photosensitive drum 62), the cleaning frame 71 (the second position determination portion) is farther away from the center (the axis of rotation) of the photosensitive drum 62 compared with the drum bearing 73 (the first position determination portion).

With the above, in a main body of the apparatus in which the cartridge B is mounted in the drum axial direction, the cartridge B does not have to be mounted along a trajectory distanced away from the non-drive side positioning portion to prevent the cartridge B from becoming damaged. As a result, the space into which the cartridge B is retracted does not have to be wastefully large, and while miniaturizing the main body of the apparatus, the cartridge B, or the photosensitive drum 62, for example, can be further prevented from becoming damaged.

Note that the present exemplary embodiment is configured such that the distance Fx from the center (the axis of rotation) of the photosensitive drum 62 to the third support 16*a*, and the distance Fy from the center (the axis of rotation) of the photosensitive drum 62 to the fourth support 16*b* are different. More Specifically, the distance Fy extending in the vertical direction is longer than the distance Fx extending in horizontal direction. While the positional accuracy of the cartridge B mounted in the main body A of the apparatus along the cartridge guide 12 is less accurate than the positional accuracy during the image-forming period, the cartridge B is positionally restricted in a predetermined range in the horizontal direction. Accordingly, while the cartridge B, or the photosensitive drum 62, for example, can be further prevented from becoming damaged, miniaturization of the non-drive side plate 16, consequently, the miniaturization of the main body A of the apparatus can be achieved and the freedom of design of the main body A of the apparatus can be increased.

Furthermore, in the present exemplary embodiment, the cleaning frame 71 (the second position determination portion) is farther away from the center of the photosensitive drum 62 (the axis of rotation) than the radius of the photosensitive drum 62. With the above, when mounting the cartridge B in the main body A of the apparatus, the third support 16*a* and the fourth support 16*b* of the non-drive side plate 16 come in contact with the cartridge B; accordingly, damage to the cartridge B can be prevented.

As described above, the present exemplary embodiment configured such that the cartridge B is mounted in the main body A of the apparatus in the drum axial direction is capable of, while reducing the size of the main body A of the apparatus, preventing the cartridge B from becoming damaged.

Note that unless explicitly stated, the functions, the materials, the shapes, and the relative positions of the components of the present disclosure are not limited to those described in the present exemplary embodiment. Furthermore, while in the present exemplary embodiment, attachment and detachment of the cartridge B with respect to the main body A of the apparatus have been described, the present configuration can be applied to the attachment and detachment of the cleaning unit with respect to the main body A of the apparatus.

Second Exemplary Embodiment

A mode of a second exemplary embodiment of the present disclosure will be described next with reference to FIGS. 9 and 10. The first exemplary embodiment is configured, on the non-drive side, such that the third abutment portion 71*f* serving as the third support, and the fourth abutment portion 71*g* serving as the fourth support that is different from the third support and that supports in a direction orthogonal to the third support are provided in the cleaning frame 71 (the second position determination portion). Accordingly, the third abutment portion 71*f* of the cleaning frame 71 (the second position determination portion) is supported by the third support 16*a*, and the fourth abutment portion 71*g* is supported by the fourth support 16*b*. However, not limited to the above, the third support and the fourth support may be provided in a single portion. Hereinafter, a description will be made with examples. Note that in the present exemplary embodiment, portions that are different from those in the first exemplary embodiment will be described in detail. Components that have similar configurations to those of the first exemplary embodiment will be attached with the same reference numerals and detailed description will be omitted.

Similar to the first exemplary embodiment, as illustrated in FIG. 9, the first abutment portion 73*y* serving as the first support that supports the load of the cartridge B is provided in the drum bearing 73 serving as the first position determination portion that abuts against the first support 15*a*. Furthermore, the second abutment portion 73*x* that supports in the direction orthogonal to the first support is provided in the drum bearing 73. The second abutment portion abuts against the second support 15*b* of the drive-side plate 15. In other words, the drum bearing 73 serving as the first position determination portion is supported by the first support 15*a* and the second support 15*b*. Furthermore, similar to the first exemplary embodiment, the boss 69*f* (FIG. 6) is provided in the drive-side hold member 69. By inserting the boss 69*f* in the long hole 15*c*, the cartridge B is supported by the drive-side plate 15.

Figure 10:
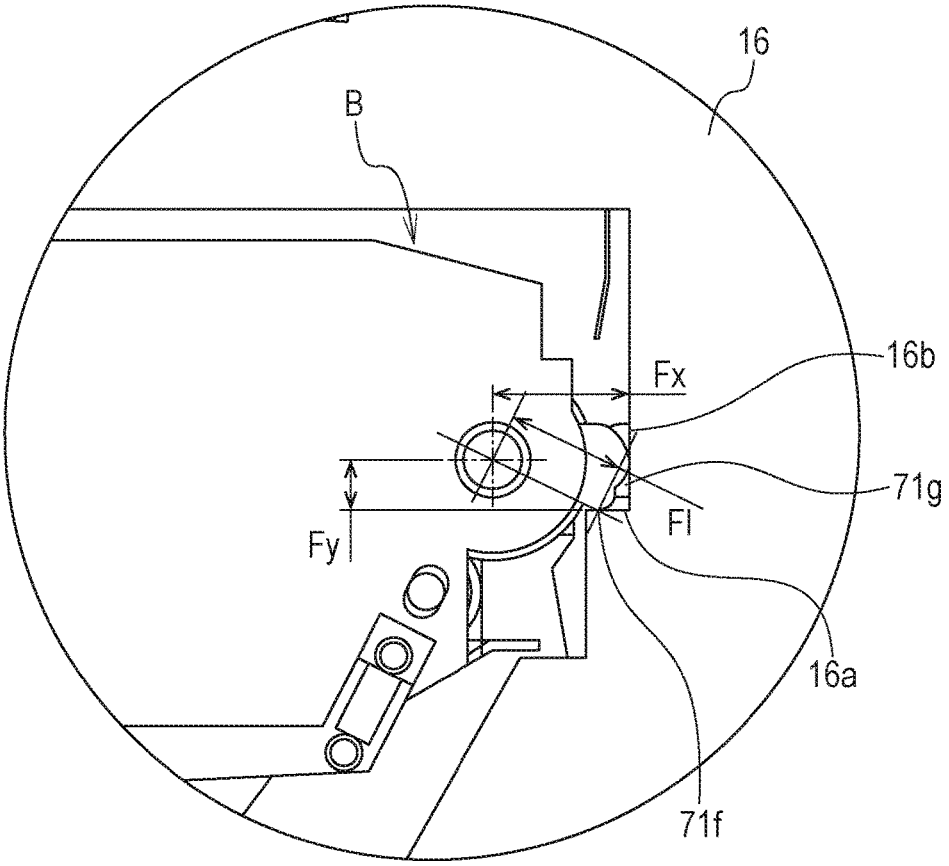
FIG. 10 is a side view of a cartridge and an image forming apparatus according to a second exemplary embodiment.

In the present exemplary embodiment, as illustrated in FIG. 10, the third abutment portion 71*f* serving as the third support that supports the load of the cartridge B is provided in the cleaning frame 71 serving as the second position determination portion that abuts against the third support 16*a*. Note that FIG. 10 is a side view viewing the drive side of the main body A of the apparatus and the cartridge B from the non-drive side.

In addition to the above, the fourth abutment portion 71*g* serving as the fourth support that supports in the direction orthogonal to the third support is provided in the portion that is the same as the portion formed as the third abutment portion 71*f* (the third support). The fourth abutment portion 71*g* is configured to abut against the fourth support 16*b* of the non-drive side plate 16. In other words, the cleaning frame 71 serving as the second position determination portion is supported by the third support 16*a* and the fourth support 16*b*.

Note the it is defined that Rx is a distance from the center (the axis of rotation) of the photosensitive drum 62 on the drive side to the first support and Ry is a distance from the center (the axis of rotation) of the photosensitive drum 62 on the drive side to the second support, in a state in which the cartridge B is mounted in the main body A of the apparatus. Furthermore, it is defined that Fx is a distance from the center (the axis of rotation) of the photosensitive drum 62 on the non-drive side to the third support and Fy is a distance from the center (the axis of rotation) of the photosensitive drum 62 on the non-drive side to the fourth support.

In the above, relationships Fx>Rx and Fx>radius of photosensitive drum 62 hold true. In other words, the distance from the center of the photosensitive drum 62 (the axis of rotation) to the fourth abutment portion 71*g* is larger than the distance from the center of the photosensitive drum 62 (the axis of rotation) to the second abutment portion 73*x* and then the radius of the photosensitive drum 62. Moreover, a distance F1 from the center (the axis of rotation) of the photosensitive drum 62 to the third support 16*a* in contact with the third abutment portion 71*f* is, in a vertical direction, larger than the radius of the photosensitive drum 62. In other words, in a cross section that is orthogonal to the mounting and detaching direction of the cartridge, the third support 16*a* and the fourth support 16*b* are provided such that the distances from the center (the axis of rotation) of the photosensitive drum 62 to the third support 16*a* and the fourth support 16*b* are larger than the radius of the photosensitive drum 62. Moreover, compared with the first support 15*a*, the third support 16*a* has a larger distance from the center (the axis of rotation) of the photosensitive drum 62 and/or compared with the second support 15*b*, the fourth support 16*b* has a larger distance from the center (the axis of rotation) of the photosensitive drum 62. In other words, in a predetermined direction, the distance from the center (the axis of rotation) of the photosensitive drum 62 to the non-drive side support is larger than the distance from the center (the axis of rotation) of the photosensitive drum 62 to the drive side support.

With the above, in a main body of the apparatus in which the cartridge B is mounted in the drum axial direction, the cartridge B does not have to be mounted through a trajectory distanced away from the non-drive side positioning portion to prevent the cartridge B from becoming damaged. As a result, the space into which the cartridge B is retracted does not have to be wastefully large, and while miniaturizing the main body of the apparatus, the cartridge B, or the photosensitive drum 62, for example, can be further prevented from becoming damaged.

Furthermore, in the present exemplary embodiment, it is only sufficient that the distance from the center of the photosensitive drum 62 to the third support 16*a* is larger than the distance from the center to the first support 15*a*, or the distance from the photosensitive drum 62 to the fourth support 16*b* is larger than the distance from the center to the second support 15*b*. In other words, if either of the condition is satisfied, the configuration does not have to satisfy the relationship Fy>Ry. Accordingly, while the cartridge B, or the photosensitive drum 62, for example, can be further prevented from becoming damaged, miniaturization of the non-drive side plate 16, consequently, the miniaturization of the main body A of the apparatus can be achieved and the freedom of design of the main body A of the apparatus can be increased.

Furthermore, in the present exemplary embodiment, the cleaning frame 71 (the second position determination portion) is farther away from the center of the photosensitive drum 62 (the axis of rotation) than the radius of the photosensitive drum 62. With the above, when mounting the cartridge B in the main body A of the apparatus, the third support 16*a* and the fourth support 16*b* of the non-drive side plate 16 come in contact with the cartridge B; accordingly, damage to the cartridge B can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-091441 filed Apr. 28, 2016, which is hereby incorporated by reference herein in its entirety.

What is claimed is:

1. A cartridge mountable on a main body of an image forming apparatus, the cartridge comprising:

a photosensitive drum;

a cleaning unit that rotatably supports the photosensitive drum;

at least one process member that acts on the photosensitive drum;

wherein the cartridge is configured to be mountable on the main body of the image forming apparatus in a mounting direction parallel to a rotational axial direction of the photosensitive drum;

a first position determination portion provided on a downstream side of the photosensitive drum in the mounting direction, configured to determine a position of the photosensitive drum on the downstream side, with respect to the main body of the apparatus, in the mounting direction; and a second position determination portion provided on an upstream side of the photosensitive drum in the mounting direction, configured to determine a position of the photosensitive drum on the upstream side, with respect to the main body of the apparatus, in the mounting direction, wherein in a cross section orthogonal to the mounting direction, a distance from an axis of rotation of the photosensitive drum to the second position determination portion in a predetermined direction is larger than a distance from the axis of rotation of the photosensitive drum to the first position determination portion in the predetermined direction.

2. The cartridge according to claim 1, wherein the first position determination portion includes a first abutment portion that protrudes vertically downwards, and a second abutment portion that protrudes in a direction orthogonal to a direction in which the first abutment portion protrudes, in a cross section orthogonal to the mounting direction, wherein the second position determination portion includes a third abutment portion that protrudes vertically downwards, and a fourth abutment portion that supports in a direction orthogonal to a direction in which the third abutment portion protrudes, in a cross section orthogonal to the mounting direction, wherein in a cross section orthogonal to the mounting direction, a distance from the axis of rotation of the photosensitive drum to the third abutment portion is larger than a distance from the axis of rotation of the photosensitive drum to the first abutment portion, and wherein in a cross section orthogonal to the mounting direction, a distance from the axis of rotation of the photosensitive drum to the fourth abutment portion is larger than a distance from the axis of rotation of the photosensitive drum to the second abutment portion.

3. The cartridge according to claim 2, wherein the distance from the axis of rotation of the photosensitive drum to the first abutment portion is larger than a radius of the photosensitive drum.

4. The cartridge according to claim 2, wherein the distance from the axis of rotation of the photosensitive drum to the second abutment portion is larger than a radius of the photosensitive drum.

5. The cartridge according to claim 1, wherein the first position determination portion includes a first abutment portion that protrudes in a first direction orthogonal to the mounting direction, and a second abutment portion that protrudes in a second direction intersecting the first direction, in a cross section orthogonal to the mounting direction, wherein the second position determination portion includes a third abutment portion that protrudes in the first direction in a cross section orthogonal to the mounting direction, wherein in a cross section orthogonal to the mounted direction, a distance from the axis of rotation of the photosensitive drum to the third abutment portion is larger than a distance from the axis of rotation of the photosensitive drum to the first abutment portion, and wherein in a cross section orthogonal to the mounted direction, the distance from the axis of rotation of the photosensitive drum to the first abutment portion and a distance from the axis of rotation of the photosensitive drum to the second abutment portion are larger than a radius of the photosensitive drum.

6. The cartridge according to claim 1, wherein the process member is either a charging member, a developing member, or a cleaning member.

7. An image forming apparatus, comprising:

a cartridge including a photosensitive drum, a cleaning unit that rotatably supports the photosensitive drum, and at least one process member that acts on the photosensitive drum; and a main body including a first side plate and a second side plate, from which the cartridge is mountable in a rotational axial direction of the photosensitive drum, a mounting direction of the cartridge being orthogonal to the first and second plates, wherein the cartridge includes a first position determination portion, and a second position determination portion provided upstream with respect to the first position determination portion in the mounting direction, wherein the first side plate includes a first regulating portion that abuts the first position determination portion of the cartridge so as to determine a position of the photosensitive drum, on a downstream side thereof in the mounting direction, with respect to the first side plate in a direction orthogonal to the mounting direction, wherein the second side plate is disposed upstream in the mounting direction with respect to the first side plate and includes a second regulating portion that abuts the second position determination portion of the cartridge so as to determine a position of the photosensitive drum, on an upstream side thereof in the mounting direction, with respect to the second side plate in the direction orthogonal to the mounting direction, and wherein in a cross section orthogonal to the mounting direction, a distance from an axis of rotation of the photosensitive drum to the second regulating portion in a predetermined direction is larger than a distance from the axis of rotation of the photosensitive drum to the first regulating portion in the predetermined direction.

8. The image forming apparatus according to claim 7, wherein the first position determination portion of the cartridge includes a first abutment portion that abuts the first regulating portion of the first plate and extends in a predetermined direction, and a second abutment portion that abuts the first regulating portion of the first plate and extends in a direction orthogonal to the predetermined direction in a cross section orthogonal to the mounting direction, wherein the second position determination portion includes a third abutment portion that abuts the second regulating portion of the second plate and extends in the predetermined direction, and a fourth abutment portion that abuts the second regulating portion of the second plate and extends in a direction orthogonal to the predetermined direction in a cross section orthogonal to the mounting direction, wherein a distance from the axis of rotation of the photosensitive drum to the third support is larger than a distance from the axis of rotation of the photosensitive drum to the first support, and wherein a distance from the axis of rotation of the photosensitive drum to the fourth support is larger than a distance from the axis of rotation of the photosensitive drum to the second support.

9. The image forming apparatus according to claim 7, wherein the first position determination portion of the cartridge includes a first abutment portion that abuts the first regulating portion of the first plate and extends in a predetermined direction, and a second abutment portion that abuts the first regulating portion of the first plate and extends in a direction intersecting the first direction in a cross section orthogonal to the mounting direction, wherein the second position determination portion of the cartridge includes a third abutment portion that abuts the second regulating portion of the second plate and extends in the first direction, in a cross section orthogonal to the mounting direction, wherein in a cross section orthogonal to the mounting direction, a distance from the axis of rotation of the photosensitive drum to the third abutment portion is larger than a distance from the axis of rotation of the photosensitive drum to the first abutment, and wherein in a cross section orthogonal to the mounting direction, the distance from the axis of rotation of the photosensitive drum to the first abutment portion and a distance from the axis of rotation of the photosensitive drum to the second abutment portion are larger than a radius of the photosensitive drum.

* * * * *